US011828567B2

(12) United States Patent
Ludlow

(10) Patent No.: US 11,828,567 B2
(45) Date of Patent: Nov. 28, 2023

(54) FIREARM STOCK WITH ADJUSTABLE CHEEK REST

(71) Applicant: H-S Precision, Inc., Rapid City, SD (US)

(72) Inventor: Christopher Ludlow, Rapid City, SD (US)

(73) Assignee: H-S PRECISION, INC., Rapid City, SD (US)

( * ) Notice: Subject to any disclaimer, the term of this patent is extended or adjusted under 35 U.S.C. 154(b) by 13 days.

(21) Appl. No.: 17/576,622

(22) Filed: Jan. 14, 2022

(65) Prior Publication Data

US 2023/0228521 A1 Jul. 20, 2023

(51) Int. Cl.
*F41C 23/14* (2006.01)

(52) U.S. Cl.
CPC ..... *F41C 23/14* (2013.01)

(58) Field of Classification Search
CPC ..... F41C 23/14; F41C 23/04
See application file for complete search history.

(56) References Cited

U.S. PATENT DOCUMENTS 5,970,642 A * 10/1999 Martin ..... F41C 23/00 42/74
2014/0259848 A1* 9/2014 Chvala ..... F41C 23/14 42/73
2019/0128639 A1* 5/2019 Parker ..... F41C 23/14
2021/0018296 A1* 1/2021 Faifer ..... F41C 23/20

* cited by examiner

*Primary Examiner* — J. Woodrow Eldred
(74) *Attorney, Agent, or Firm* — Bennet K. Langlotz; Langlotz Patent & Trademark Works, LLC

(57) ABSTRACT

A firearm stock with adjustable cheek rest has a base having a base side portion configured to overlay a selected major face of the stock, the base having a base upper portion connected to the side portion and configured to extend over the uppermost crest line to the opposed upper surface away from the selected major face, the base upper portion having a first base upper portion surface configured to overlay the first stock upper surface, and a second base upper portion surface configured to overlay the second stock upper surface, and a cheek piece connected to the base and movable with respect to the base between a lower position and an upper position, and a plurality of intermediate positions. The base side portion, first base upper portion surface, and second base upper portion surface may be adhered to various portions of the stock.

13 Claims, 5 Drawing Sheets

FIREARM STOCK WITH ADJUSTABLE CHEEK REST

FIELD OF THE INVENTION

The present invention relates to firearms, and more particularly to a firearm having an adjustable cheek rest.

BACKGROUND AND SUMMARY OF THE INVENTION

A cheek rest is a device on a rifle stock that supports the shooter's cheek at a height suitable for use with the sights. High sights such as telescopic sights require higher cheek rests, and low sights such as iron sights require lower cheek rests. Different users' preferences and physiology also suggest the advantage of enabling different cheek rest heights for any given rifle configuration.

These devices vary significantly between firearms, and various adjustable cheek rests are known. Conventional approaches to adjustable cheek rests require the time-consuming use of tools to loosen and tighten fasteners to adjust the height of the cheek rest. In the field, tools and extended amounts of time to adjust the cheek rest may not be available.

Therefore, a need exists for a new and improved firearm stock with adjustable cheek rest that enables rapid tool-less adjustment of the cheek rest. In this regard, the various embodiments of the present invention substantially fulfill at least some of these needs. In this respect, the firearm stock with adjustable cheek rest according to the present invention substantially departs from the conventional concepts and designs of the prior art, and in doing so provides an apparatus primarily developed for the purpose of enabling rapid tool-less adjustment of the cheek rest.

The present invention provides an improved firearm stock with adjustable cheek rest, and overcomes the above-mentioned disadvantages and drawbacks of the prior art. As such, the general purpose of the present invention, which will be described subsequently in greater detail, is to provide an improved firearm stock with adjustable cheek rest that has all the advantages of the prior art mentioned above.

To attain this, the preferred embodiment of the present invention essentially comprises a base having a base side portion configured to overlay a selected major face of the stock, the base having a base upper portion connected to the side portion and configured to extend over the uppermost crest line to the opposed upper surface away from the selected major face, the base upper portion having a first base upper portion surface configured to overlay the first stock upper surface, and a second base upper portion surface configured to overlay the second stock upper surface, and a cheek piece connected to the base and movable with respect to the base between a lower position and an upper position, and a plurality of intermediate positions. The base side portion may be adhered to the major face of the stock, the first base upper portion surface may be adhered to the first stock upper surface, and the second base upper portion surface may be adhered to the second stock upper surface. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
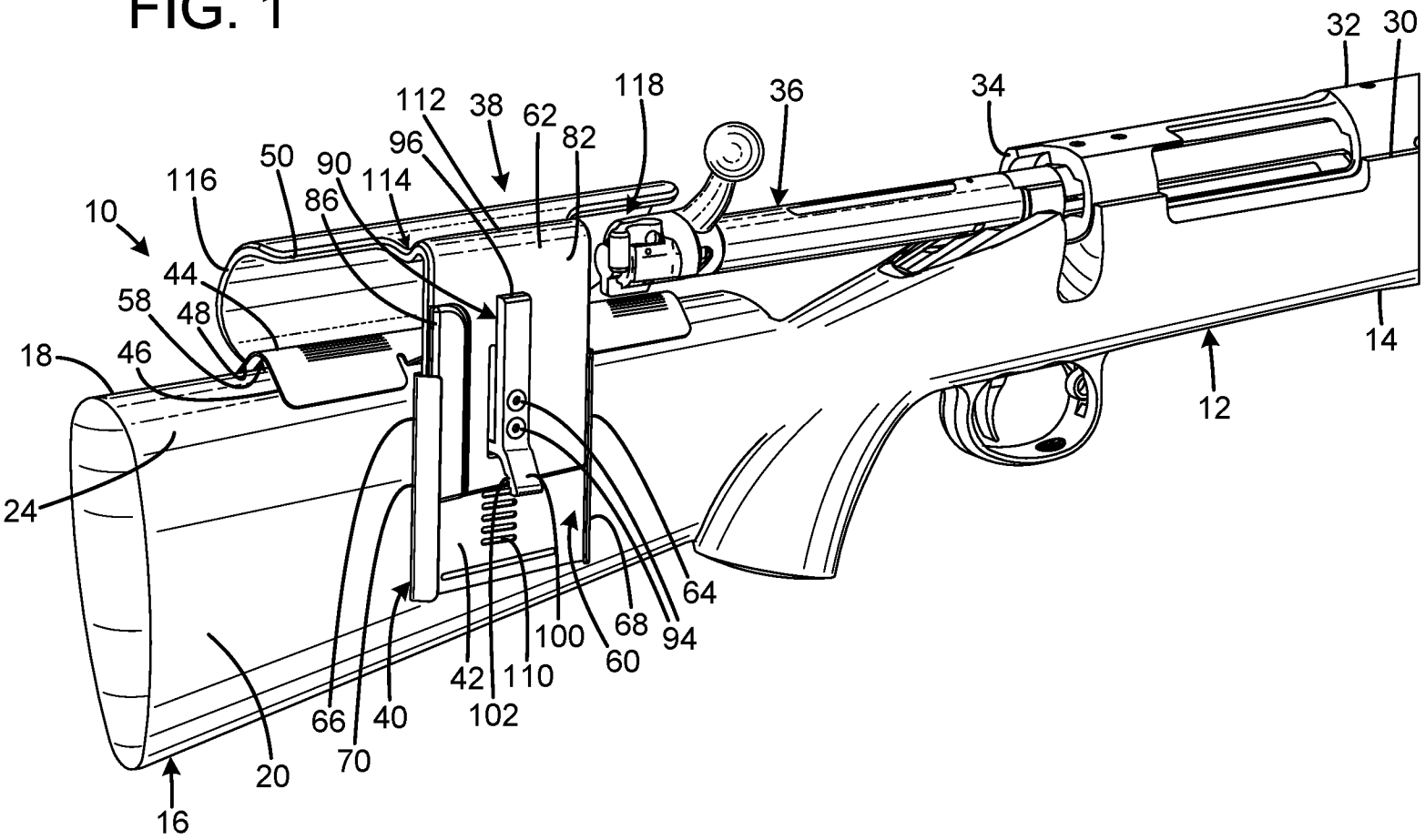
FIG. 1 is a rear isometric view of the current embodiment of the firearm stock with adjustable cheek rest constructed in accordance with the principles of the present invention with the cheek piece adjusted to the highest position to enable removal of the bolt assembly.
Figure 2:
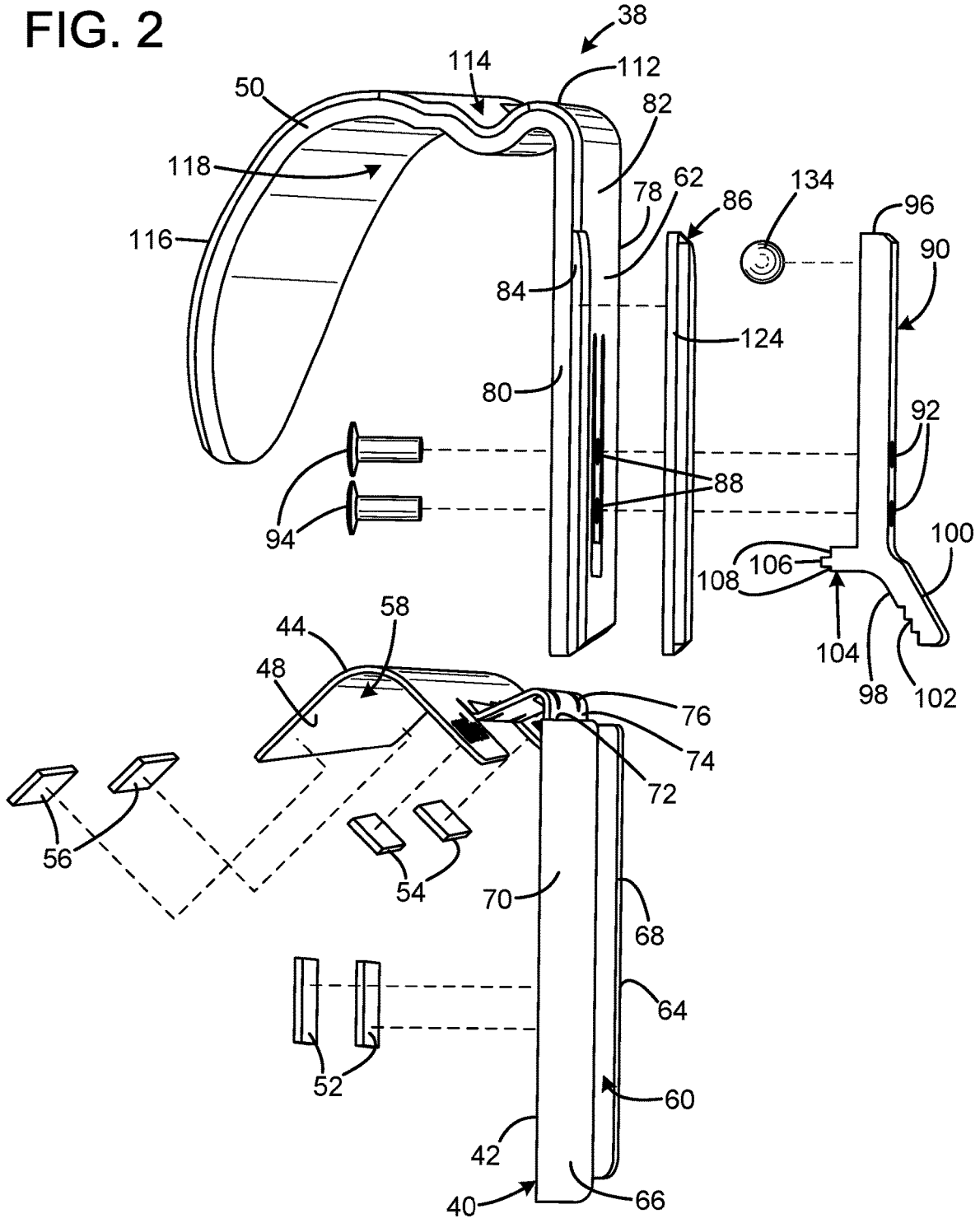
FIG. 2 is a rear exploded view of the current embodiment of the firearm stock with adjustable cheek rest of FIG. 1.

An embodiment of the firearm stock with adjustable cheek rest of the present invention is shown and generally designated by the reference numeral 10.

FIGS. 1-4 illustrate the improved firearm stock with adjustable cheek rest 10 of the present invention. More particularly, the firearm stock is an elongated body 12 having a forend 14 and an opposed butt stock portion 16. The butt stock portion has an uppermost crest line 18, a first major face 20, and a second major face 22 (visible in FIG. 3). The uppermost crest line separates opposed first and second stock upper surfaces 24, 26 each angling in opposite directions angularly offset away from a vertical direction 28 associated with the uppermost crest line. The top 30 of the stock body 12 receives a receiver 32 having a rear 34. A bolt assembly 36 is slidably received within the rear of the receiver.

Figure 3:
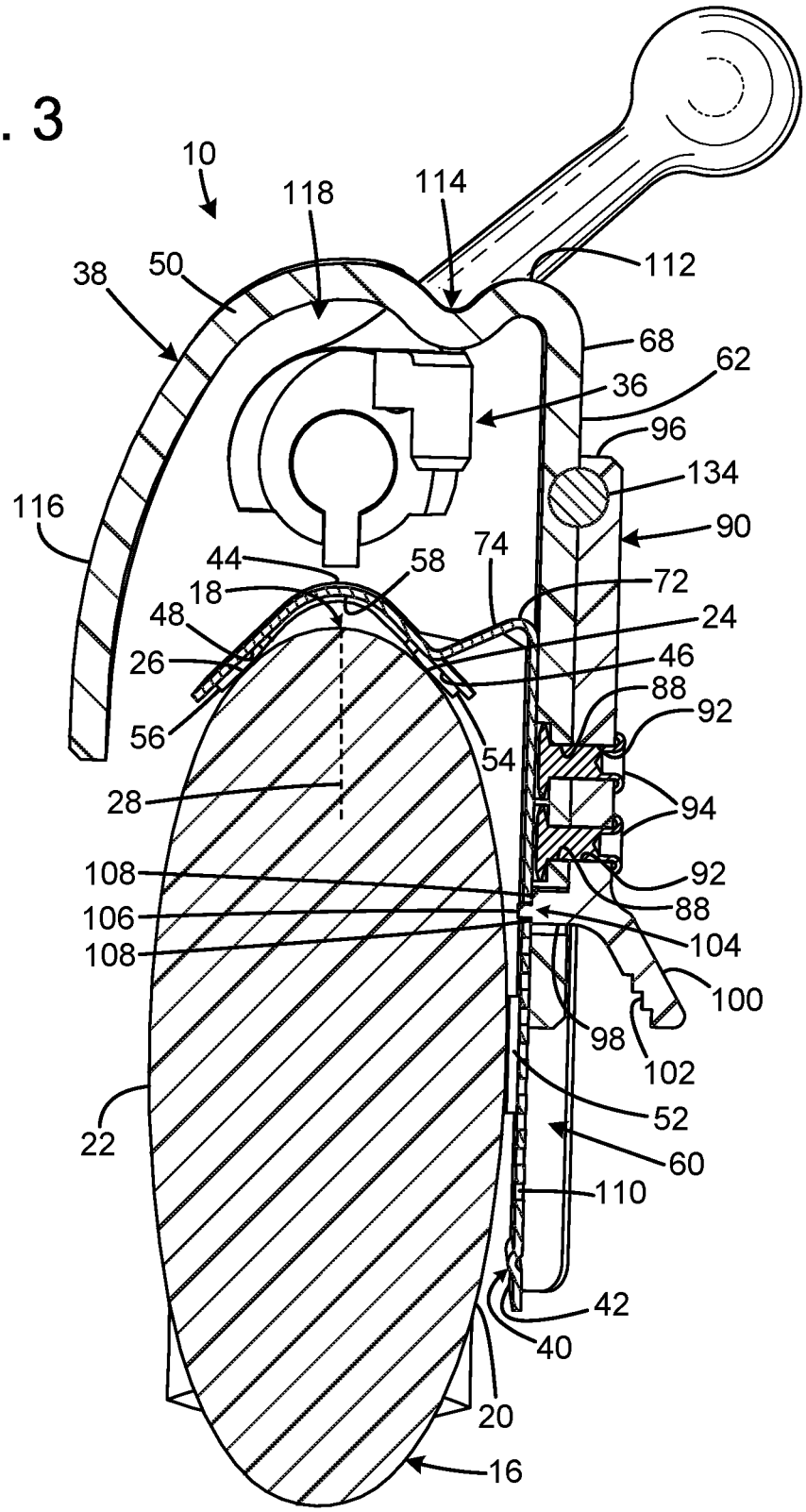
FIG. 3 is a side sectional view of the current embodiment of the firearm stock with adjustable cheek rest with the cheek piece adjusted to the highest position to enable removal of the bolt assembly.
Figure 4:
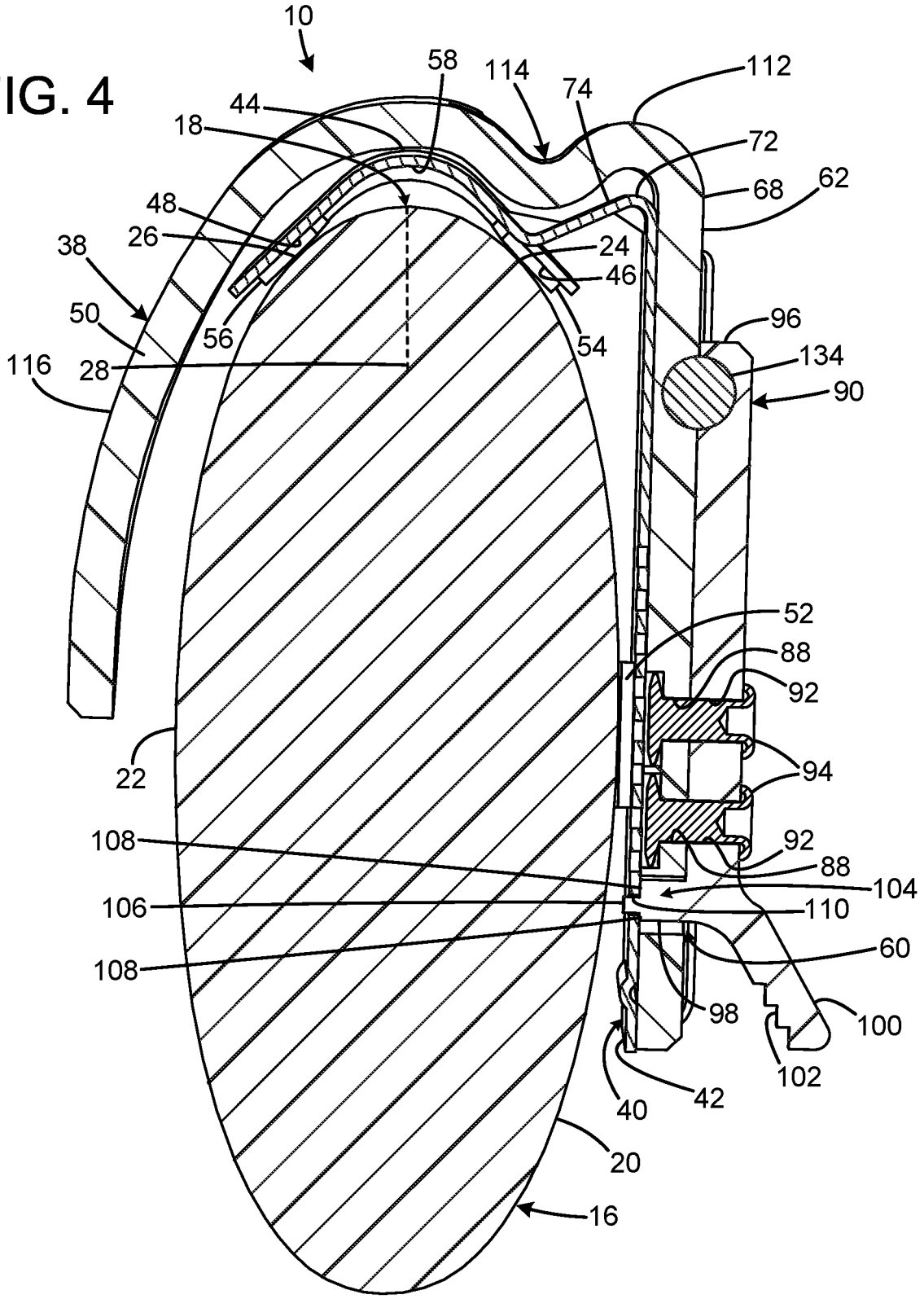
FIG. 4 is a side sectional view of the current embodiment of the firearm stock with adjustable cheek rest with the cheek piece adjusted to the lowest position.

An adjustable cheek rest 38 is attached to the butt stock portion 16 of the stock body 12. In FIGS. 1 and 3, the adjustable cheek rest is shown adjusted to the highest position. In FIG. 4, the adjustable cheek rest is shown adjusted to the lowest position. The adjustable cheek rest has a base 40 having a base side portion 42 configured to overlay a selected major face of the stock body. In the current embodiment, the adjustable cheek rest is suitable for use by a right-handed shooter and overlays the first major face 20 of the stock body. However, the same principles can be used to produce an adjustable cheek rest suitable for use by a left-handed shooter that overlays the second major face 22 of the stock body. The base has a base upper portion 44 connected to the base side portion and configured to extend over the uppermost crest line 18 to the opposed upper surface away from the selected major face. In the current embodiment, the base upper portion extends to the second stock upper surface 26, which is away from the first major face 20. The base upper portion has a first base upper portion surface 46 configured to overlay the first stock upper surface 24 and a second base upper portion surface 48 configured to overlay the second stock upper surface. In the current embodiment, the base upper portion has a V-shape cross-section, and the first stock upper surface and the second stock upper surface are perpendicular to each other. A cheek piece 50 is connected to the base and is movable with respect to the base between a lower position and an upper position, and a plurality of intermediate positions.

The base side portion 42 is adhered to the major face of the stock by two tape pieces 52. The first base upper portion surface 46 is adhered to the first stock upper surface 24 by two tape pieces 54. The second base upper portion surface is adhered to the second stock upper surface 26 by two tape pieces 56. Thus, the first base upper portion surface and the second base upper portion surface are each elongated elements, each having an adhesive element at each opposed end. In the current embodiment, the tape pieces are 3M™ 5952, 45 mil, double-sided VHB™ tape manufactured by 3M of St. Paul, MN These high-strength, double-sided acrylic foam tape pieces create a long-lasting bond that strengthens over time. They will bond to sealed wood, aluminum, steel, glass, low surface energy plastics, and painted and powder-coated surfaces. Thus, the tape pieces form a permanent bond between the butt stock portion 16 of the stock body 12 and the 20 ga. 304 stainless steel used to form the base 40.

The base upper portion 44 defines a downward-facing, vertical 45° channel 58 between the first base upper portion surface 46 and the second base upper portion surface 48. The base upper portion is an elongated member overlaying a major portion of the uppermost crest line 18. The base side portion defines a channel 60 receiving a vertical support portion 62 of the cheek piece 50. The base 40 is an articulated sheet having a consistent thickness.

The base side portion 42 has a front 64 and a rear 66. The front defines a short dovetail bend 68, and the rear defines a long dovetail bend 70. The channel 60 is defined between the short and long dovetail bends. The top 72 of the base side portion forms a Z bend portion 74 that connects the base side portion to the base upper portion 44. The Z bend portion includes four gussets 76 for stiffening and reinforcement. The base upper portion is a V bend portion, which is adaptable to many different stock body sizes and styles. It should be appreciated that the base 40, including the base side portion, Z bend portion, and base upper portion, is of unitary construction.

The vertical support portion 62 of the cheek piece 50 has a front edge 78, rear edge 80, and an outer face 82. A gib recess 84 is an elongate recess defined in the outer face along the rear edge and closely receives an elongate gib 86. The vertical support portion defines two apertures 88 that are arranged vertically. A latch 90 has two apertures 92 that are arranged vertically and are axially registered with the apertures 88 so that two rivets 94 received in apertures 88, 92 permanently fasten the latch to the outer face of the vertical support portion. The latch has a top 96 and a bottom 98. The bottom of the latch includes a latch tab 100 protruding outwardly from the latch away from the vertical support portion. The latch tab includes a plurality of grooves 102 that increase grip to facilitate pulling of the latch tab outwardly from the vertical support portion. The latch is a pull style to prevent accidental change to the height setting of the vertical support portion of the cheek piece during rough handling of the stock body 12. The bottom of the latch also includes a latch catch 104 that protrudes inwardly from the latch towards the vertical support portion. The latch catch includes a tooth/protrusion 106 that defines shoulders 108 on either side.

The vertical support portion 62 of the cheek piece 50 defines a plurality of engagement features, each configured to be engaged by engagement element on the cheek piece. In the current embodiment, the engagement features are height adjustment slots/openings 110, and the engagement element is the tooth/protrusion 106 on the latch catch 104. In the current embodiment, there are nine height adjustment slots vertically spaced 0.150 inch apart. The tooth/protrusion is selectably received by a selected one of the height adjustment slots to restrain vertical movement of the cheek piece in a selected position. When the tooth is received by a height adjustment slot, the shoulders 108 on either side rest against the base side portion 42.

A tension ball 134 is captured between the top 96 of the latch 90 and the outer face 82 of the vertical support portion 62. The tension ball creates spring pressure on the latch 90 such that the tooth 106 is biased medially toward the base side portion 42 such that a tension force away from the butt stock portion 16 is required to adjust the vertical position of the cheek piece 50. The amount of tension force required can be adjusted by varying the size of the tension ball and its resilience characteristics. Application of a tension force away from the butt stock portion is accomplished by gripping the grooves 102 of the latch tab 100, pulling the latch tab outwardly from the base side portion 42 until the tooth is removed from the initial height adjustment slot 110, raising or lowering the vertical support portion within the channel 60 until the desired height of the cheek piece is achieved, and then releasing the latch tab inwardly towards the base side portion until the tooth is received within a suitable height adjustment slot to restrain vertical movement of the cheek piece.

The top 112 of the vertical support portion 62 of the cheek piece 50 forms a creased contour 114 to add rigidity and stability. A full-size pad portion 116 of the cheek piece extends above the uppermost crest line 18 and curves over the second stock upper surface 26 of the butt stock portion 16. The pad portion has chamfered edges for comfort. The pad portion defines a downward-facing bolt clearance notch 118 that enables the bolt assembly to be removed from the rear 34 of the receiver 32 without first requiring removal of the cheek piece provided the cheek piece is first adjusted to the highest height adjustment slot 110. The cheek piece can also be completely removed from the base 40 by disengaging the tooth 106 of the latch catch 104 from the height adjustment slots and pulling the vertical support portion out of the channel 62 through the top 72 of the base side portion 42. In the current embodiment, the cheek piece is made of 0.156 inch-thick black KYDEX® 100, which is a thermoplastic acrylic-polyvinyl chloride material manufactured by Sekisui SPI of Bloomsburg, PA.

Figure 5:
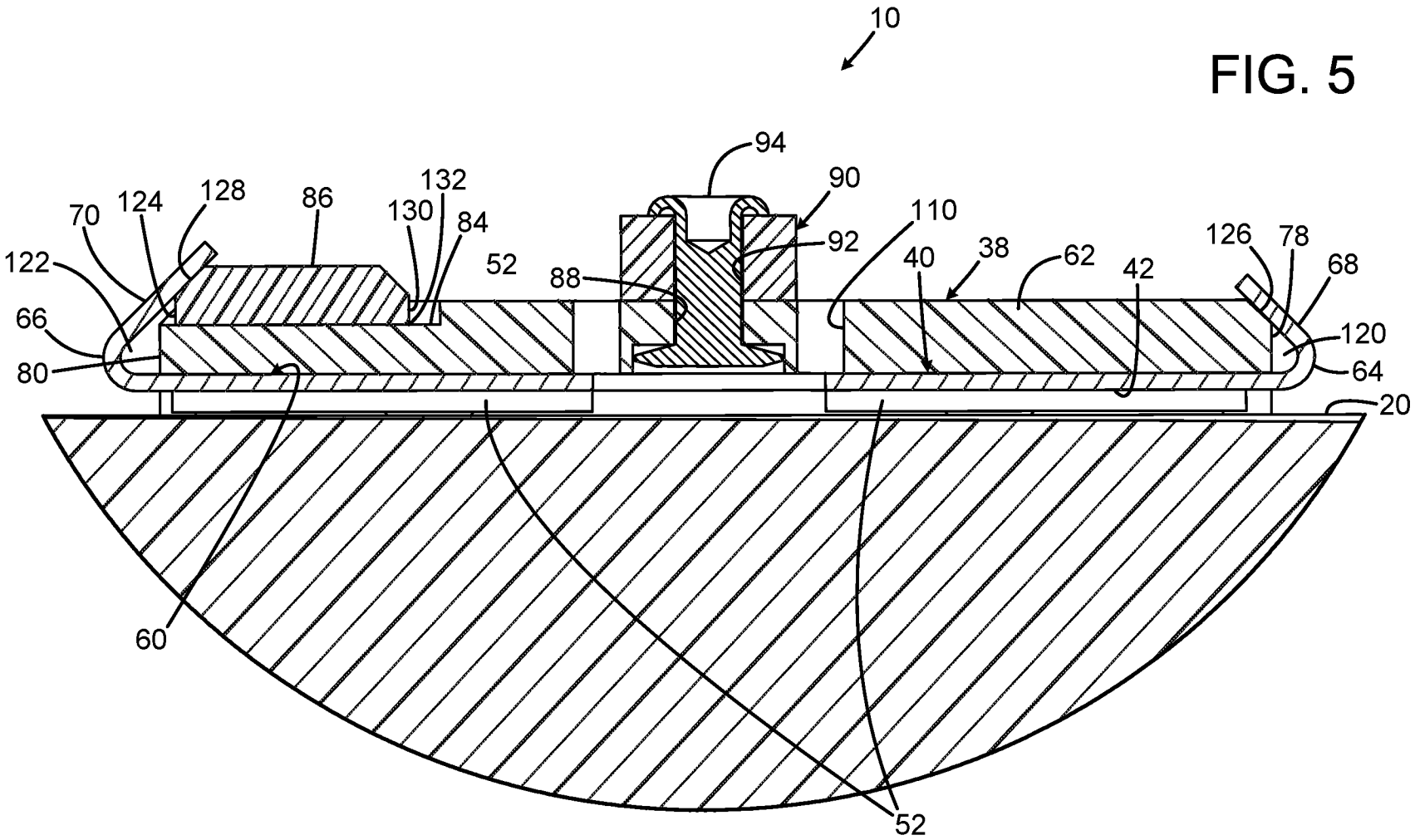
FIG. 5 is an enlarged partial bottom sectional view of the current embodiment of the firearm stock with adjustable cheek rest with the cheek piece adjusted to the lowest position.

FIG. 5 illustrates the improved firearm stock with adjustable cheek rest 10 of the present invention. More particularly, the vertical support portion 62 of the cheek rest is shown inserted into the channel 60 of the base side portion 42 of the base 40. The short dovetail bend 68 defines a front dovetail way 120 that receives the front edge 78 of the vertical support portion, and the long dovetail bend 70 defines a rear dovetail way 122 that receives the rear edge 80 of the vertical support portion and the rear edge 124 of the gib 86. The front edge 78 of the vertical support portion has a 45° bevel 126 to engage the short dovetail bend. The rear edge of the gib has a 45° bevel 128 to engage the long dovetail bend.

The gib 86 is secured to the outer face 82 of the vertical support portion 62 of the cheek piece 50 within the gib recess 84 by dispensing Methyl ethyl ketone liquid adhesive along the front edge 130 of the gib where it contacts the outer face at location 132. Capillary action draws the liquid adhesive between the gib and the outer face of the cheek piece and welds the materials together through a chemical reaction. During the application of the liquid adhesive, the gib is forced against the long dovetail bend 70 while the vertical support portion is forced against the short dovetail bend 68 to ensure a snug and slop-free fit of the vertical support portion within the channel 60.

In the context of the specification, the terms "rear" and "rearward," and "front" and "forward" have the following definitions: "rear" or "rearward" means in the direction away from the muzzle of the firearm while "front" or "forward" means it is in the direction towards the muzzle of the firearm.

While a current embodiment of a firearm stock with adjustable cheek rest has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An adjustable cheek rest for a rifle stock having a butt with opposed major faces and an uppermost crest line separating opposed first and second stock upper surfaces each angling in opposite directions angularly offset away from a vertical direction associated with the uppermost crest line, the cheek rest comprising:

a base having a base side portion configured to overlay a selected major face of the stock;

the base having a base upper portion connected to the base side portion and configured to extend over the uppermost crest line to the opposed upper surface away from the selected major face;

the base upper portion having a first base upper portion surface configured to overlay the first stock upper surface, and a second base upper portion surface configured to overlay the second stock upper surface; and a cheek piece connected to the base and movable with respect to the base between a lower position and an upper position, and a plurality of intermediate positions.

2. The adjustable cheek rest of claim 1 wherein the base side portion is adhered to the major face of the stock, the first base upper portion surface is adhered to the first stock upper surface, and the second base upper portion surface is adhered to the second stock upper surface.

3. The adjustable cheek rest of claim 2 wherein the first base upper portion surface and the second base upper portion surface are each elongated elements and each having an adhesive element at each opposed end.

4. The adjustable cheek rest of claim 1 wherein the base upper portion defines a downward facing channel.

5. The adjustable cheek rest of claim 1 wherein the base upper portion is an elongated member overlaying a major portion of the uppermost crest line.

6. The adjustable cheek rest of claim 1 wherein the base side portion defines a channel receiving a vertical support portion of the cheek piece.

7. The adjustable cheek rest of claim 6 wherein the channel is a vertical channel.

8. The adjustable cheek rest of claim 1 wherein the base side portion defines a plurality of engagement features, each configured to be engaged by an engagement element on the cheek piece.

9. The adjustable cheek rest of claim 8 wherein the engagement features are openings, and the engagement element includes a protrusion that is selectably received by the openings to restrain vertical movement of the cheek piece in a selected position.

10. The adjustable cheek rest of claim 9 wherein the protrusion is biased medially toward the base side portion such that a tension force away from the butt is required to adjust the cheek piece position.

11. The adjustable cheek rest of claim 1 wherein the base portion is formed of steel.

12. The adjustable cheek rest of claim 1 wherein the cheek piece is formed of plastic.

13. The adjustable cheek rest of claim 1 wherein the base upper portion has a V-shape cross section.

* * * * *